US007584965B2

(12) United States Patent
Harrison

(10) Patent No.: US 7,584,965 B2
(45) Date of Patent: Sep. 8, 2009

(54) LOTTERY GAME SYSTEM AND METHOD

(76) Inventor: Joseph E. Harrison, 2541 Milford Rd., University Heights, OH (US) 44118

( * ) Notice: Subject to any disclaimer, the term of this patent is extended or adjusted under 35 U.S.C. 154(b) by 420 days.

(21) Appl. No.: 11/152,961

(22) Filed: Jun. 15, 2005

(65) Prior Publication Data

US 2005/0280210 A1 Dec. 22, 2005

Related U.S. Application Data

(60) Provisional application No. 60/580,674, filed on Jun. 17, 2004.

(51) Int. Cl.
*A63F 3/00* (2006.01)

(52) U.S. Cl. ..... 273/269; 463/17

(58) Field of Classification Search ..... 273/269; 463/17

See application file for complete search history.

(56) References Cited

U.S. PATENT DOCUMENTS 4,560,171 A 12/1985 Anthony
4,591,162 A 5/1986 Fakhoury
5,158,293 A 10/1992 Mullins
5,531,448 A 7/1996 Moody
5,657,991 A 8/1997 Camarato
5,682,819 A 11/1997 Beaty
5,718,432 A 2/1998 Fraser
6,210,276 B1 4/2001 Mullins
6,435,500 B2 8/2002 Gumina
6,457,714 B1 10/2002 Feola
6,524,184 B1 2/2003 Lind
6,527,175 B1 3/2003 Dietz et al.
6,572,107 B1 6/2003 Walker
6,599,187 B2 7/2003 Gerow
6,733,385 B1 5/2004 Enzminger et al.
2003/0050109 A1 * 3/2003 Caro et al. ..... 463/17
2004/0186600 A1 * 9/2004 Tumacder et al. ..... 700/91
2005/0064930 A1 * 3/2005 Jubinville et al. ..... 463/17

* cited by examiner

*Primary Examiner*—Vishu K. Mendiratta
(74) *Attorney, Agent, or Firm*—Pearne & Gordon LLP

(57) ABSTRACT

A system and method for playing a lottery game based on a card game which may have both instant win aspects and lottery drawing aspects.

3 Claims, 5 Drawing Sheets

©2004 Hasco ™

LOTTERY GAME SYSTEM AND METHOD

CROSS-REFERENCES TO RELATED APPLICATIONS

This application claims the benefit of provisional application Ser. No. 60/580,674, filed on Jun. 17, 2004, incorporated herein by reference.

The disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

The present invention relates to a gaming system and, more particularly, to a lottery/casino type gaming system.

Lottery/casino type games of chance have exhibited enduring popularity, because such games typically permit a player to make a relatively small wager by buying a ticket with a chance of winning a significantly large award. In addition to the entertainment value that such games provide for the players, these types of games typically provide a source of revenue for the operator, normally a lottery, but sometimes a municipality or a business establishment, or a casino.

One type of game system which has proven quite popular with players is the so-called "instant" lottery ticket games. In this type of game, the player purchases scratch-off tickets for a relatively nominal sum, with each ticket displaying gaming symbols, selected ones of which may correspond to award values. In a typical configuration, each ticket comprises a lamination of latex scratch-off material covering the gaming symbols. The game symbols are thus initially sealed, and are revealed by the player by "scratching-off" the latex material. The Gumina U.S. Pat. No. 5,118,109 is a good example of the above.

Another type of game system which has also proven very popular with players is a so-called "daily number" game. In this type of game, the player chooses, for example, 3 numbers from a field of 1,000 numbers, i.e., from 000 to 999. The lottery/operator will generate a ticket with the player's numbers on it, along with other information like the time and date. Typically, there is a bar code printed on this ticket for verification purposes.

Upon completion of the selling period for the game, the lottery/game operator will, for the example, randomly "draw" 3 numbers from the field of 1,000. Players then will match their chosen numbers with those drawn by the lottery/operator to see if there is a winning combination. It is worth noting that some people utilize a feature called, for example, the "quick pick". In this instance, the lottery/game operator randomly picks the numbers for the player at the time of purchase and before the drawing. The "quick pick" numbers are randomly generated by the lottery/operator terminal, and the ticket is printed for the customer at that time.

Additional related art is found in U.S. Pat. Nos. 6,733,385; 6,527,175; 6,599,187; 6,524,184; 6,572,107; 6,457,714; 6,435,500; 6,210,276; 5,718,432; 5,682,819; 5,657,991; 5,531,448; 5,158,293; 4,591,162; and 4,560,171; all incorporated by reference.

However, affording players an opportunity to win prize amounts in different ways, and at different times, enhances the entertainment value of a lottery game, and provides the lottery with additional products for sale, potentially increasing revenue. It has, therefore, been considered desirable to develop a new and improved lottery/casino games, and methods for playing such games.

SUMMARY OF THE INVENTION

Provided is a method for playing a lottery game, comprising the steps of:

- providing a random plurality of symbols randomly chosen from a pool of unique symbols each representing a unique card from a deck of playing cards used for a card game;
- allowing the player to select a chosen plurality of symbols from the pool of symbols;
- awarding an instant prize to the player if the plurality of symbols matches one of a plurality of predefined subsets of symbols from the pool, wherein each one of the predefined subsets of symbols represents a different winning hand according to the card game;
- drawing a winning subset of symbols from the pool subsequent to the providing step;
- awarding a second prize to the player if some number of symbols from the random plurality of symbols matches the some number of symbols of the winning subset of symbols; and
- awarding a third prize if some number or some other number of the chosen plurality of symbols match the some number or some other number, respectively, of symbols of the winning subset of symbols.

Also provided is a system for playing a lottery game, comprising: means for providing a random plurality of symbols randomly chosen from a pool of unique symbols each representing a unique card from a deck of playing cards used for a card game; means for allowing the player to select a chosen plurality of symbols from the pool of symbols by the player using a player ticket having the pool of symbols printed thereon for the selecting, such that the player marks the chosen plurality of symbols on the card and wherein the system reads the card to determine the chosen plurality of symbols; means for printing at least one ticket with the random plurality of symbols and the chosen plurality of symbols printed thereon; and means for drawing a winning subset of symbols from the pool subsequent to the printing.

An instant prize is awarded to the player if the plurality of symbols matches one of a plurality of predefined subsets of symbols from the pool, wherein each one of the predefined subsets of symbols represents a different winning hand according to the card game. A second prize is awarded to the player if some number of symbols from the random plurality of symbols matches the some number of symbols of the winning subset of symbols. Furthermore, a third prize is awarded to the player if some number or some other number of the chosen plurality of symbols match the some number or some other number, respectively, of symbols of the winning subset of symbols.

BRIEF DESCRIPTION OF THE DRAWINGS

The patent or application file contains drawings protected by copyright.

The foregoing and other features and advantages of the present invention will become apparent to those skilled in the art to which the present invention relates upon reading the following description with reference to the accompanying drawings, in which.

DETAILED DESCRIPTION OF THE PREFERRED EMBODIMENTS

Figure 1:
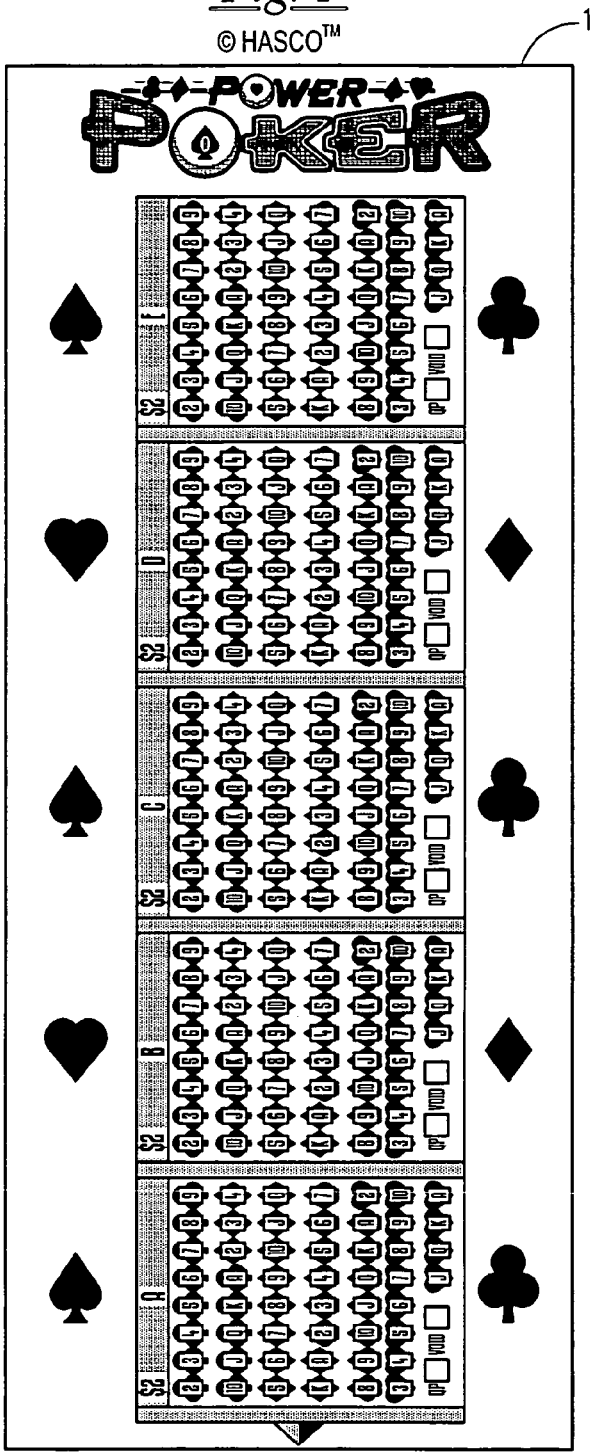
FIG. 1 is a diagrammatic representation of an example of a player card, for supporting one embodiment of the invention.

In accordance with a first aspect of the present invention, a system for use in playing a game of chance is provided. The system includes a plurality of playing cards, or symbols representing each card of a deck of playing cards. For example, a ball may be marked with symbols representing playing cards, or the playing card may be displayed on a computer monitor, for example. Furthermore, each card of the deck of playing cards might re presented by a printed symbol, such as a number or letter over a graphic representing the card suite, for example.

A standard "deck" of 52 cards typically comprises 2 through ace (A) of each suite of clubs, diamonds, hearts and spades. In the first aspect of the game, the lottery/game operator, which might include a retailer or other party authorized to participate in the lottery, can provide the player with a "player card", with each of the 52 cards of a deck of cards represented by a unique symbol, thus forming a pool of symbols. An example embodiment of a player card 1 is shown in FIG. 1, which has five play areas so that the player can play multiple games using a single card.

The player card 1 is arranged so that the player can choose his favorite 5 cards by marking the appropriate player card symbols. Note that the number "5" is chosen for the first aspect of the invention because that is the typical number of cards chosen for a popular version of the game of poker, but other numbers of cards could also be chosen, such as 6 or 7, for example. In particular, using 7 cards is also particularly desirable because it represents an additional version of poker that is also popular. However, even more additional games, including non-poker games, can be implemented to utilize different numbers and/or types of cards.

Figure 1A:
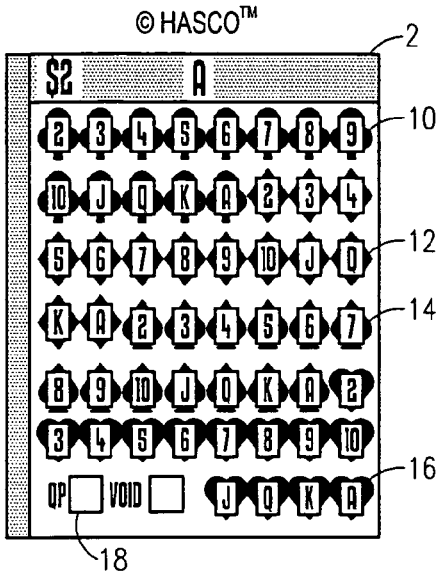
FIG. 1*a* is a blow up of a section of the player card of FIG. 1.

Lottery/casino operators can offer the player card 1 of FIG. 1 to the customer or player at a place of ticket purchase, for example. FIG. 1*a* is a blow up of the play area A of FIG. 1, showing the 52 card deck individual card symbols, 2 through ace of clubs, 2 through ace of diamonds, 2 through ace of spades, and 2 through ace of hearts for a single poker game. In particular, note the 9 of clubs symbol 10, the Queen of diamonds symbol 12, the 7 of spades symbol 14, and the ace of hearts symbol 16. Other symbols are similarly shown. There is also a QP box 18 provided for the player to choose a "quick pick" option (described below), and a "void" box for voiding the play area should the player make a mistake, for example.

The player chooses his set of 5 (or other number of) cards by darkening the box of the symbol with a pencil or pen, for example. The player returns the marked player card 1 to the lottery agent/game operator with any of A through E play areas marked with the player's desired sets of 5 (or other number of) card symbols (representing the player's cards). The operator in turn feeds the card into the lottery/operator terminal, which is likely a computer terminal of a type known in the art, where the player card 1 is read or scanned, and an official player ticket is printed or generated, with the players chosen cards for each of the games played shown on the ticket in symbol form, for example.

Figure 2:
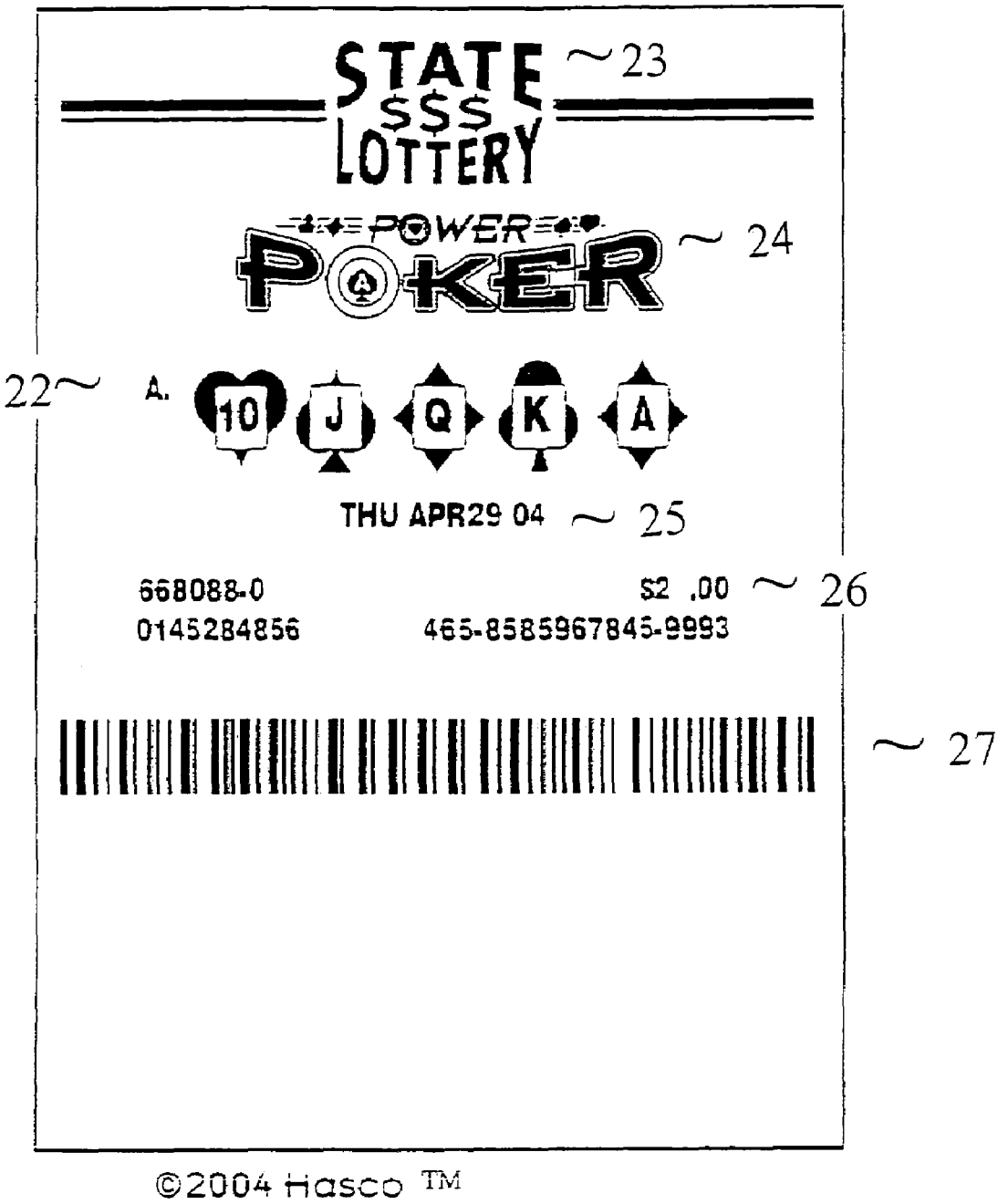
FIG. 2 is a diagrammatic representation of an example ticket showing data structure employed by one aspect of the invention.

An example of such a ticket is shown in FIG. 2, which represents a single game A played at line 22, showing a 10 of Hearts, a Jack of Spades, a Queen of Diamonds, a King of Clubs, and an Ace of Diamonds. Note that the ticket also shows the title of the lottery 23, the game name 24, the date 25, cost information 26, a bar code 27, and any additional desired information.

For this first aspect of the invention, the player has a chance to win on the "drawing" of the game. At a later time, typically at a scheduled time, for example, the lottery/game operator will draw, at random, symbols representing 5 cards from the field of 52. This could be done, for example, by choosing 5 balls from a collection of 52 balls, each appropriately marked with a corresponding card symbol. The results are then posted in some fashion to communicate the results to the player, such as online or on a bulletin board or display, or otherwise communicated to players, such as via television, radio, or a newspaper, for example.

The player will then try to match his chosen 5 cards for each game played to the winning subset of cards "drawn" by the lottery/game operator. Prize pay out will be afforded all players who match all 5 cards of the winning subset, maybe a reduced prize for 4 cards that match the cards of the winning subset, and perhaps even a 3 card match, for example. Because the chance of picking all 5 cards is low, the prize payout for such a win could be made substantially large. Of course, different numbers of cards can be drawn for winning subsets, and different numbers of matches required for a prize, depending on the version of the game and/or the odds of winning desired.

Jackpots could be made progressive if no player wins a given drawing, such that some portion of the prize that was not won is added to the prizes for the subsequent game. This can be repeated until one or more winners obtain the prize, for example, causing increased jackpots and thus possibly increasing interest in the game.

A second aspect of the present invention also calls for the above standard 52 playing cards or a similar game, but in this instance the game is enhanced by the random draw "quick pick" feature. At the time of purchase, the player will order from the lottery/operator a "quick pick" random subset of cards/symbols. The player may, or may not, use the player card as defined above. If the player card is used, the "QP box" is marked for the "quick pick" feature. Alternatively, the player might request one or more "quick pick" plays directly from the operator, such as orally, for example.

In this instance, the lottery/operator terminal will generate/print a ticket with the symbols for 5 (or another number of) cards randomly drawn by the terminal for the player. This feature allows for a separate prize pool from the drawing prize.

The player is thus given an opportunity to win instantly by drawing a predetermined winning hand. The player attempts to match his random set of "cards" with one of a plurality of winning hand of cards each made up of a subset of the cards of the deck of cards, for example.

An example game would be if the player were to "draw" a ticket with a winning poker hand, such as a pair of jacks, for example. A larger prize would be offered for each ascending poker hand value, according to the probability of drawing that hand. The order would typically be 2 pair, 3 of a kind, a straight, a flush, a full house, 4 of a kind, and a straight flush typically being the highest rank. Different card games would typically have different winning hands, but the principle is the same. Furthermore, card games utilizing wild cards (e.g., "deuces wild"), or additional wild cards added to the deck, (e.g., two joker cards in a "deck" of 54), could also be utilized. Such games may be known as variations of poker play.

Players would also have a second chance to win by matching their 5 "quick pick" cards to the 5 cards that will be drawn by the lottery/operator at the later scheduled drawing, as outlined above for the first aspect of the invention. This play style may be more attractive to some players, as it affords them the instant gratification of possibly winning at the time of purchase, with no messy scratch off tickets to execute, coupled with the excitement of potentially winning a larger jackpot at a later time.

Obviously, for a game utilizing the instant win feature, the player cannot choose his five cards as in the first aspect, because the player would obviously choose a winning combination. Thus, only a randomized option is available for the instant win option. Furthermore, the use of wild cards may, or may not, have an impact on the drawing portion of the game. For example, using deuces wild might have no impact on the drawing, requiring an exact match to win drawing prizes, while using a wild card such as a joker might be accommodated by also allowing a "wild card" function in the drawing, but perhaps at reduced prizes.

Figure 3:
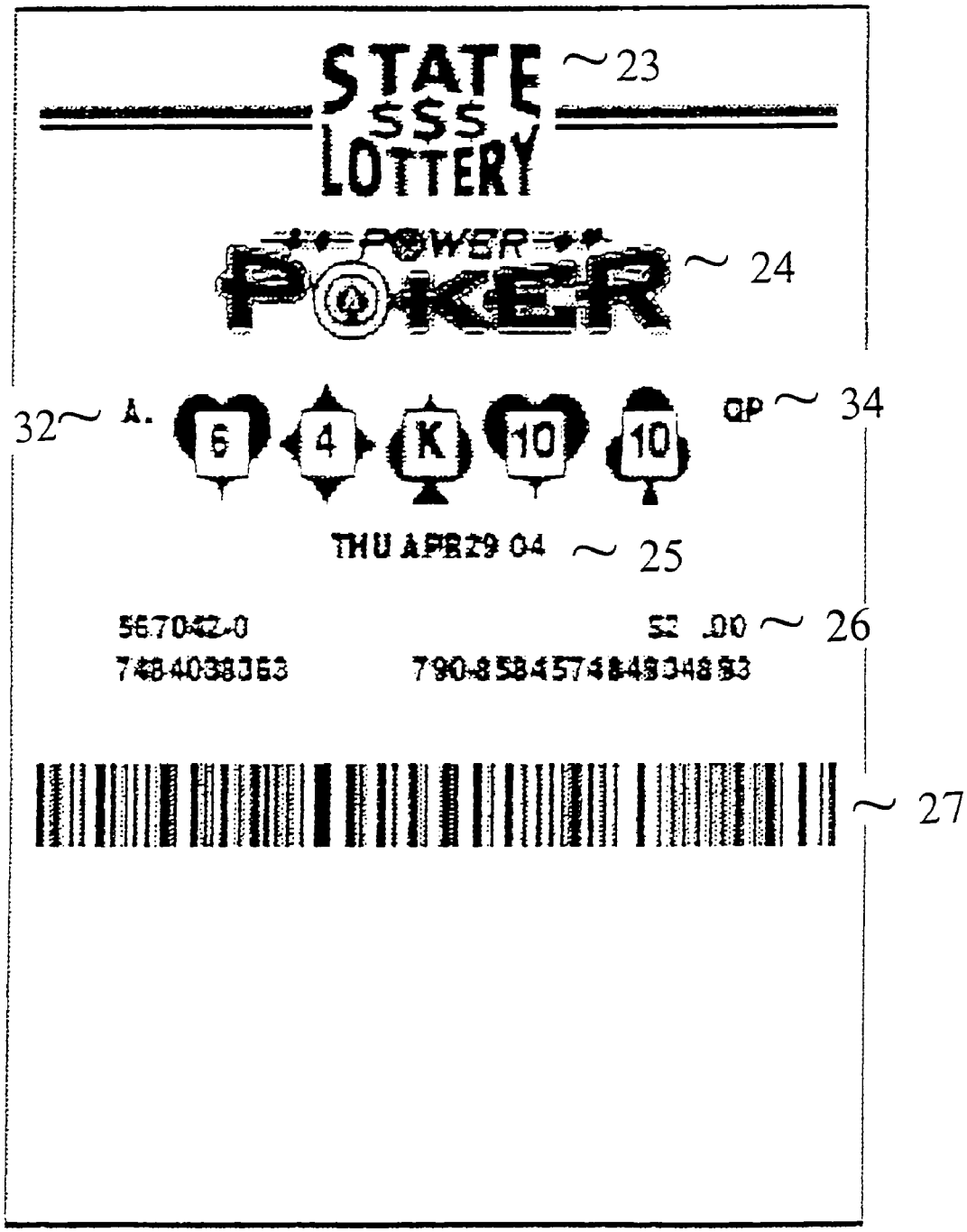
FIG. 3 is a diagrammatic representation of an example of a quick pick ticket showing data structure employed by another aspect of the invention.

FIG. 3 shows an example of a ticket generated by playing a single "quick pick" example game as described above. The game line 32 shows a 6 of hearts, a 4 of diamonds, a king of spades, a 10 of hearts, and a 10 of clubs. Note that the ticket has a pair of 10's, which may be a winning hand, although some games might restrict winning hands to require higher pairs, such as a pair of Jacks or better, for example, or a three-of-a-kind or better might be required. Note that the "quick pick" option is noted by the QP symbol 34.

A third aspect of the present invention calls for the above two aspects being combined. That is, a player can pick their 5 favorite cards by utilizing the player card. On the player card, in addition to the 52 cards, is a box for the "quick pick" option. The player having picked their favorite 5 cards, and also marking the "quick pick" option box, returns the card to the lottery agent/game operator.

Figure 4:
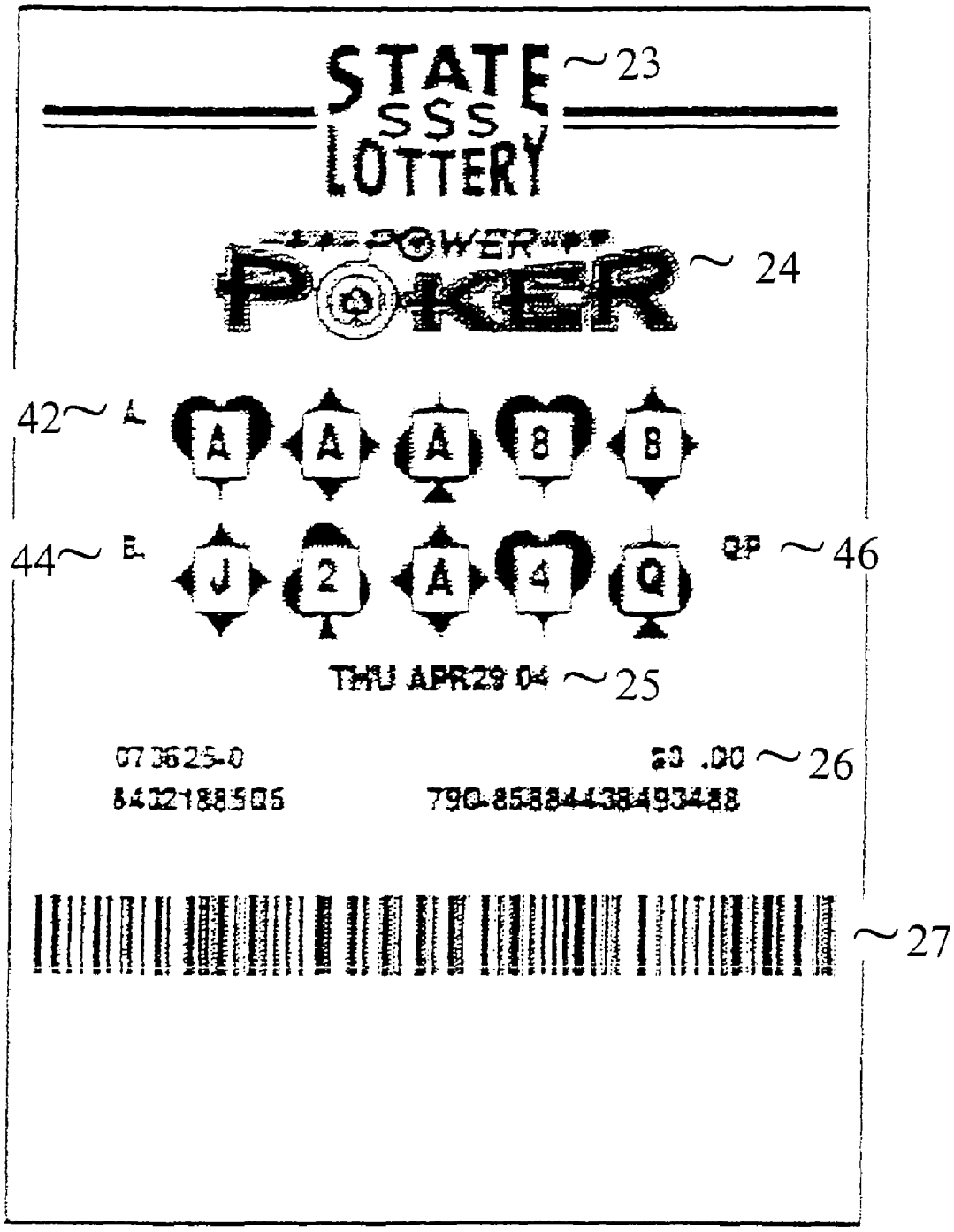
FIG. 4 is a diagrammatic representation of a combination ticket of still another aspect of the invention.

The lottery/operator inserts the player card into the terminal and it is read or scanned. The terminal prints or generates a ticket with two lines of play, such as that shown in the example of FIG. 4. The first line 42 can have the players 5 chosen cards, and the second line 44 can be the 5 randomly drawn cards from the quick pick option. The player then has a ticket that affords him/her the chance to win an instant cash prize and possibly the drawing prize by way of the quick pick option, and also holds a ticket with his favorite or "lucky" chosen cards for the drawing as well.

There are various ways that this third aspect could be implemented. For example, the "quick pick" option might provide only an instant game, and with only the chosen cards being used for the drawing, or both the chosen cards and the quick pick cards might qualify for the drawing. In this second version, the quick pick option may be made to cost more than the chosen card option, because it affords two chances to win (i.e., both the instant win and the drawing win).

Thus, pricing for the various aspects of the invention could be that the chosen cards cost $1 per game, for example, but the "quick pick" might cost $2, for example, if it also provides a chance to win the drawing. There might also be alternatives to purchase a "quick pick" instant option only, that could not be used for the drawing, for example, at a lower cost.

Furthermore, note that a player could choose numerous plays by using more than one of the areas A-E shown in the example player ticket of FIG. 1. Note that a player could also play numerous quick picks on the same card, resulting in as many as 5 chosen card plays and 5 quick pick plays for the same card. Of course, other combinations and numbers of plays per card are possible, and a player could use numerous player cards to play additional games.

For the second and third aspects of the invention, the ticket might utilize a feature that allows the immediate cashing in of a winning instant play, but also allows the player to retain the ticket or a portion of the ticket to play the drawing portion of the game as well. Such a ticket could utilize features similar to those found in U.S. Pat. No. 5,934,671, for example, incorporated herein by reference. Alternatively, the player might provide the operator with the ticket, and the operator would mark the ticket in some fashion to show that the ticket has already been redeemed for the instant payout. This marking could be done automatically by a machine that scans the ticket to verify it as a winning ticket, for example.

Figure 5:
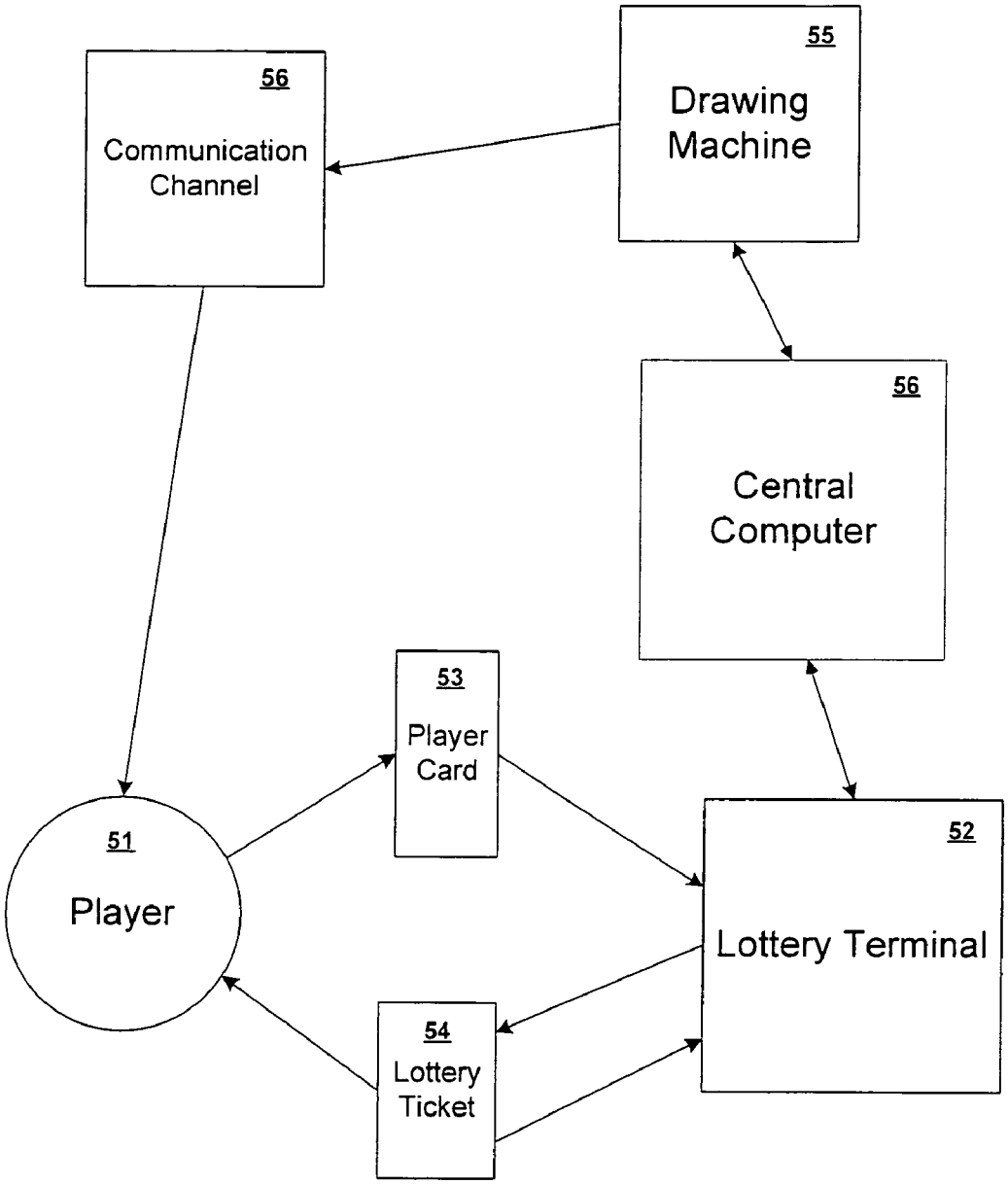
FIG. 5 is a block diagram showing the major components that might be utilized to implement a system to implement a game of the invention.

FIG. 5 shows a possible embodiment of a system for playing the games disclosed herein. The player 51 can submit the player card 53 to an operator of the lottery terminal 52. The lottery terminal 52, which is likely computerized, then prints the lottery ticket 54 which is returned to the player 51. The player can then check to see if he has won an instant game, if played. If an instant game is won, the player might return the ticket 54 to the operator of the terminal 52. The terminal 52 then verifies that the ticket is a winning ticket, such as by reading a bar code on the ticket, and then the operator may pay the player the prize.

The terminal 52 or its operator may mark the ticket in some fashion to show that the instant prize was paid out, and the terminal 52 will likely record that fact. Alternatively, the player may be required to surrender his ticket to the lottery for payment of the instant prize, after which the terminal 52 prints a new replacement ticket with the appropriate numbers for the drawing portion of play. These numbers would include a copy of any chosen numbers on the original ticket and/or a copy of the quick pick numbers for the drawing. These could be automatically printed based on the ticket coding as determined by the terminal 52. The ticket may then note that the instant prize has already been paid out, or that the numbers are only good for the drawing, for example.

Later, a drawing machine 55, which may be computerized, or may be a ball machine, for example, then draws a winning subset of cards, as described above. The player 51 is notified of the winning subset via some communication channel 56, which could be television, radio, the internet, a bulletin board, newspaper, or display, for example. The communication channel 56 may be in contact with the drawing machine 55, or a central computer 56 (described below), for example. Then, the player can turn in a winning ticket, if any, to the lottery terminal 52 for prize payout, or the player may need to turn the ticket in to some other authority in order to obtain larger prizes.

The central computer 56, or alternatively a set of distributed computers, will typically keep track of the operation of the lottery terminal, the prize payouts, and will likely provide oversight for the system to prevent fraud, for example, and to avoid improper multiple payouts (likely by monitoring a serial number of tickets that have had prized paid for). As another alternative, one or both of the Lottery terminal 52, and drawing machine 55 may be combined with the central computer 56, if desired. Even the communication channel 56 might be combined with the above components to create a self-contained device that might be found in a casino, for example, such that a single computerized terminal performs the functions of each of these components and displays the drawing results to the player using some type of graphical or alphanumeric display of any known type, for example.

The above system might be implemented to utilize existing lottery equipment, for example, requiring some amount of new programming in order to support the games disclosed herein. Alternatively, the system may be put together from scratch.

As a further option, the system could be utilized for a multi-state, multi-jurisdiction, or multi-casino game. Such an option might allow the use of much larger prized for the drawing, in particular for situations where the odds of winning the drawing are very low, leading to common roll-over prizes. In such a case, the system may need to communicate over much larger distances or with more diverse terminal designs, thus possibly requiring a more flexible design.

The invention has been described hereinabove using specific examples and embodiments; however, it will be understood by those skilled in the art that various alternatives may be used and equivalents may be substituted for elements and/or steps described herein, without deviating from the scope of the invention. Modifications may be necessary to adapt the invention to a particular situation or to particular needs without departing from the scope of the invention. It is intended that the invention not be limited to the particular implementations and embodiments described herein, but that the claims be given their broadest interpretation to cover all embodiments, literal or equivalent, disclosed or not, covered thereby.

What is claimed is:

1. A method for playing a lottery game, comprising the steps of:

providing a random plurality of symbols randomly chosen from a pool of unique symbols each representing a unique card from a deck of playing cards used for a card game;

printing or displaying said random plurality of symbols using a lottery terminal;

allowing the player to select a chosen plurality of symbols from said pool of symbols;

awarding an instant prize to said player if said random plurality of symbols matches one of a plurality of predefined subsets of symbols from said pool, wherein each one of said predefined subsets of symbols represents a different winning hand according to the card game;

randomly drawing a winning subset of symbols from said pool subsequent to said providing step;

awarding a second prize to said player if some number of symbols from said random plurality of symbols matches said some number of symbols of said winning subset of symbols; and awarding a third prize if some number or some other number of said chosen plurality of symbols match said some number or some other number, respectively, of symbols of said winning subset of symbols.

2. The method of claim 1, wherein said random plurality of symbols and said chosen plurality of symbols are printed on at least one ticket at the time of said providing step.

3. The method of claim 2, wherein said step of allowing the player to select a chosen plurality of symbols includes the step of the player using a player ticket having said pool of symbols printed thereon for said selecting, such that the player marks said chosen plurality of symbols on said card.

* * * * *

UNITED STATES PATENT AND TRADEMARK OFFICE

CERTIFICATE OF CORRECTION

PATENT NO. : 7,584,965 B2
APPLICATION NO. : 11/152961
DATED : September 8, 2009
INVENTOR(S) : Joseph E. Harrison It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 351 days.

Signed and Sealed this

Fourteenth Day of September, 2010

David J. Kappos

David J. Kappos
*Director of the United States Patent and Trademark Office*